US005995054A

United States Patent [19]

Massey

[11] Patent Number: 5,995,054

[45] Date of Patent: Nov. 30, 1999

[54] COMMUNICATIONS DEVICE

[76] Inventor: Peter J. Massey, 14 The Meadway, Horley, United Kingdom, RH6 9AN

[21] Appl. No.: 09/275,366

[22] Filed: Mar. 24, 1999

[30] Foreign Application Priority Data

Mar. 28, 1998 [GB] United Kingdom ..... 9806612

[51] Int. Cl.[6] ..... H01Q 11/12; H01Q 1/24

[52] U.S. Cl. ..... 343/744; 343/743; 343/870; 343/866

[58] Field of Search ..... 343/744, 741, 343/743, 748, 702, 855, 866, 870; H01Q 11/12, 1/24

[56] References Cited

U.S. PATENT DOCUMENTS 4,920,353 4/1990 Mori et al. ..... 343/702
5,710,987 1/1998 Paulick ..... 343/702

FOREIGN PATENT DOCUMENTS

0341238B1 11/1989 European Pat. Off. ..... H01Q 1/27

*Primary Examiner*—Hoanganh Le
*Attorney, Agent, or Firm*—Jack D. Slobod

[57] ABSTRACT

A communications device comprises a loop antenna having a plurality of feed terminals defining at least two terminal pairs. A controller is provided for selecting one terminal pair to enable reception or transmission from the loop antenna using the selected terminal pair. The selection of terminal pair is made based on the measurement of at least one parameter which is responsive to the proximity to the antenna of, for example, a user of the device. One terminal pair provides an antenna having matched impedance when the user is near the device, and the other terminal pair provides an antenna having matched impedance when the user is distant.

10 Claims, 1 Drawing Sheet

COMMUNICATIONS DEVICE

This invention relates to communications devices, and particularly devices using loop antennas. Loop antennas are commonly used for radio receivers having low bandwidth requirements, such as pagers. Typically, a loop antenna is tuned to the frequency of operation of the communications device by a tuning capacitor. There have also been proposals to introduce additional tuning elements to enable a loop antenna to be tuned to operate over multiple channels.

It has been recognised, for example in EP 0 341 238, that when a communications device employing a loop antenna is to be placed near the human body there can be a detuning effect on the antenna. EP 0 341 238 proposes a tuning system comprising a varactor tuning diode which introduces a variable capacitance into the antenna loop, for tuning the antenna to a selected frequency. This system enables the antenna to be tuned with the device in situ (namely on the person who is wearing the communications device), so that optimum antenna performance can be obtained when the device is worn. It has also been recognised in the prior art that the proximity of a user of a device to the loop antenna of the device alters the resonant frequency of the antenna, and it has therefore been proposed to alter the reactance of the loop to manipulate that resonant frequency.

The present invention is based on the realisation that the degradation of the antenna performance which is observed when the antenna is brought near to a user results from real impedance changes of the antenna caused by the user proximity, rather than from changes in the resonant frequency. It is well known that the positioning of a loop antenna adjacent to a large object such as the human body results in shielding of some energy from the loop antenna. However it has been found that impedance change to the antenna contributes significantly to the reduction in antenna performance, and even dominates the degradation of antenna performance in certain conditions.

This realisation has led to the design of a device employing a loop antenna which can operate with different impedances depending upon detection of user proximity. Thus, according to a first aspect of the invention, there is provided a communications device comprising a loop antenna having a plurality of feed terminals defining at least two terminal pairs, control means for selecting one terminal pair to enable reception or transmission from the loop antenna using the selected terminal pair, wherein the selection of terminal pair is made by the control means based on the measurement of at least one parameter which is responsive to the proximity to the antenna of objects which absorb electromagnetic energy at or around the operating frequency of the antenna.

The selection of terminal pair determines the impedance at the terminals of the antenna, and the positioning of the terminal pairs according to the invention is such that one terminal pair is appropriate for signal reception/transmission when the antenna is distant from the user, and the other terminal pair is appropriate for signal reception/transmission when the antenna is close to the user. The selection of antenna terminals is based on a parameter or parameters which are influenced by the proximity of the user.

This parameter may comprise one or more of the bandwidth of the antenna, the impedance of the loop measured at a terminal pair, and the reception quality of a known signal at the antenna. Each of these parameters are characteristics which are influenced by the presence of a lossy object in the vicinity of the loop antenna.

One terminal of each of the at least two terminal pairs may be common to the pairs. Thus, in its simplest form the loop antenna of the invention comprises three terminals.

According to a second aspect of the invention there is provided a pager comprising a communications device as described above.

According to a third aspect of the invention there is provided a method of selecting one terminal pair in a communications device comprising a loop antenna having a plurality of feed terminals defining at least two terminal pairs, the method comprising measuring at least one parameter which is responsive to the proximity to the antenna of objects which absorb electromagnetic energy at or around the operating frequency of the antenna.

The invention will now be described by way of example with reference to, and as shown in, the accompanying drawings, in which.

Figure 1:
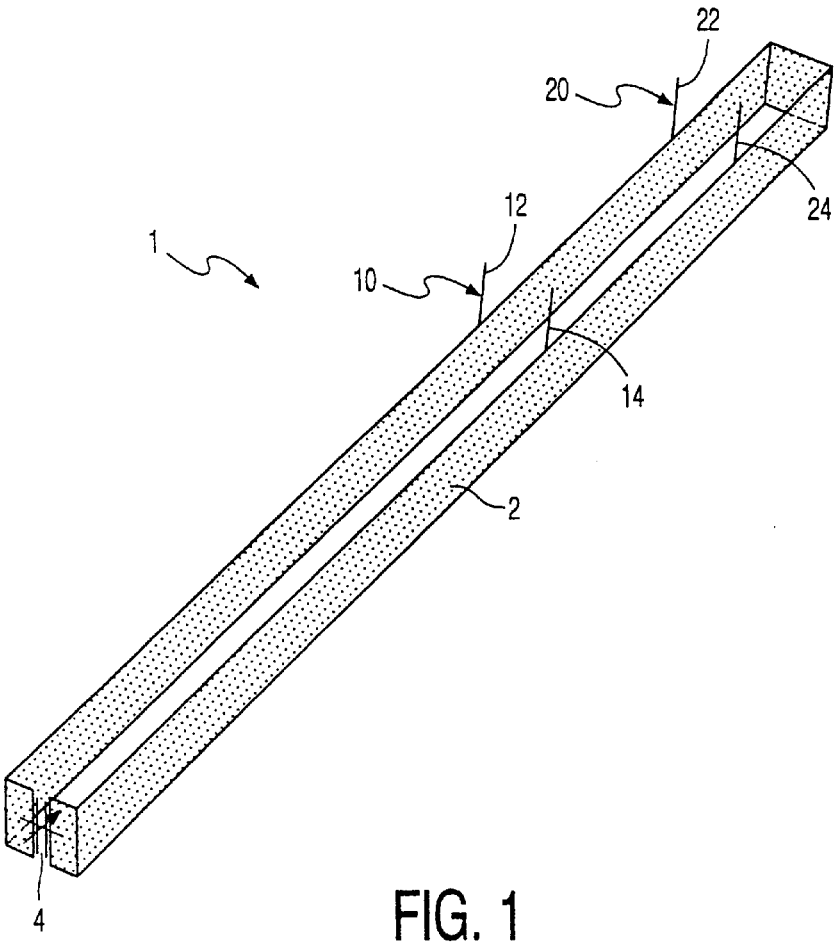
FIG. 1 shows a loop antenna in accordance with the invention.

The loop antenna 1 shown in FIG. 1 comprises a single turn bent strip loop antenna 2 with a tuning capacitor 4 connected in series with the loop. The value of the capacitive element and the inductance of the loop are selected so that the circuit is tuned to the desired frequency of the electromagnetic waves for reception and/or transmission. These features of the loop antenna are conventional in the art, and various possible designs for loop antennas will be appreciated by those skilled in the art. As one example, the conductive loop 2 may be formed from a metal foil strip and bent into the desired single turn loop. This bent metal foil may be supported by an insulating jig, or alternatively the metal foil may be provided on a rigid substrate.

Instead of the three dimensional loop antenna shown in FIG. 1, there are also many possible designs of two dimensional loop antennas, which may for example comprise a screen-printed metallic layer having the desired configuration and provided over an insulating substrate.

Although the loop antenna shown in FIG. 1 comprises a single tuning capacitor in series with the loop, it may instead be desirable to provide a plurality of capacitors arranged around the loop. The provision of a number of capacitors distributed in series around the loop has been proposed as one measure to reduce the problem of detuning of the antenna as a result of user proximity. The use of a number of series capacitors around the loop reduces the effect of additional stray capacitances believed to be introduced into the loop as a result of user proximity. A printed distributed capacitance loop has also been proposed, wherein additional series capacitances are defined by the structure of the antenna loop, rather than being introduced as additional discrete components.

The solution given by the present invention may be applied to a loop antenna in addition to the known measures described above. The specific construction and production techniques for any particular loop antenna will not be described in detail since those skilled in the art will be aware of the possibilities available.

The invention resides in the provision of multiple feeds for a loop antenna, and in the control of switching between the multiple feeds. The loop antenna shown in FIG. 1 comprises two pairs of feeds 10, 20 for supplying signals to the antenna or for receiving signals from the antenna. In FIG. 1, each pair of feeds comprises two feed terminals 12,14 and 22, 24. The position of the feed terminals will determine the impedance across those terminals, and in particular the real part of the loop impedance. It has been found by the applicant that the degradation of antenna performance in the presence of lossy objects (namely objects which absorb electromagnetic radiation at the frequency of operation) is at least partly the result of impedance changes in the antenna caused by the proximity of the lossy object.

The ability to select feed terminals to give different antenna impedance enables the antenna impedance to be matched to the receiving/transmitting circuitry both when the communications device is positioned in free space and when it is positioned adjacent the user.

The control of the switching between terminal pairs is effected in order to take into account the user proximity to the loop antenna. For this purpose, parameters are identified which vary in response to the presence of energy absorbing objects, in practice the user of the device. Several such parameters have been identified, and the operation of the antenna requires monitoring of one or more of these parameters in order to select the most appropriate feed connection to the antenna.

It has been recognised by the applicant that the proximity of a lossy object influences the impedance of the antenna, and consequently this impedance is an appropriate control parameter for the selection of feed terminals. Direct impedance measurement may be appropriate if the device using the antenna is provided with a signal generating circuit, for example as in the case of two-way pagers. In such a case, the signal generating circuit can be used as a test signal generator for impedance measurement. The impedance may also be determined by measuring the reflected power from the antenna terminals in response to a known input, which provides a measure of the impedance mismatch.

The impedance change of the antenna also alters reduces quality factor of the antenna, with a consequent increase in the bandwidth. The bandwidth response may also be analysed to obtain a bandwidth measurement if a signal generator is present capable of providing the necessary test sweep signal.

Internal measurement of the impedance or of the bandwidth response of the antenna may not be appropriate for a device which includes only a receiver, such as a one-way pager, because no circuit capable of providing the radio frequency test signal is available, so that additional dedicated circuitry would then be required.

To avoid the need for this dedicated circuitry, bandwidth response analysis could alternatively be achieved by controlling the communications network such that training pulses are periodically sent to the communications equipment within the network. For the purpose of bandwidth detection, the training pulse could comprise a signal having a known intensity over the full range of operating frequencies. Analysis of the received signal, and comparison with the known original signal could be used to create a model of the antenna response over the full range of frequencies, and thereby determine the operating bandwidth of the loop antenna.

The bandwidth response analysis or impedance measurements described above could be performed for both terminal connection configurations of the antenna. However, measurement could be taken for only one terminal configuration, and an analysis of the single measurement should enable the appropriate terminal selection to be made.

Other performance indicators of the antenna when coupled using different feeds could also be tested as the parameter for controlling the selection of feed terminals. These performance indicators could also be monitored in response to known training pulses sent out by the network to the communications device. Thus, in response to known signal transmissions, algorithms may be implemented for monitoring error bit rates, signal attenuation or other such variables. Again, it may be possible to perform measurements at only one terminal pair, or it may be preferred to compare signals from both terminal pairs in succession.

Figure 2:
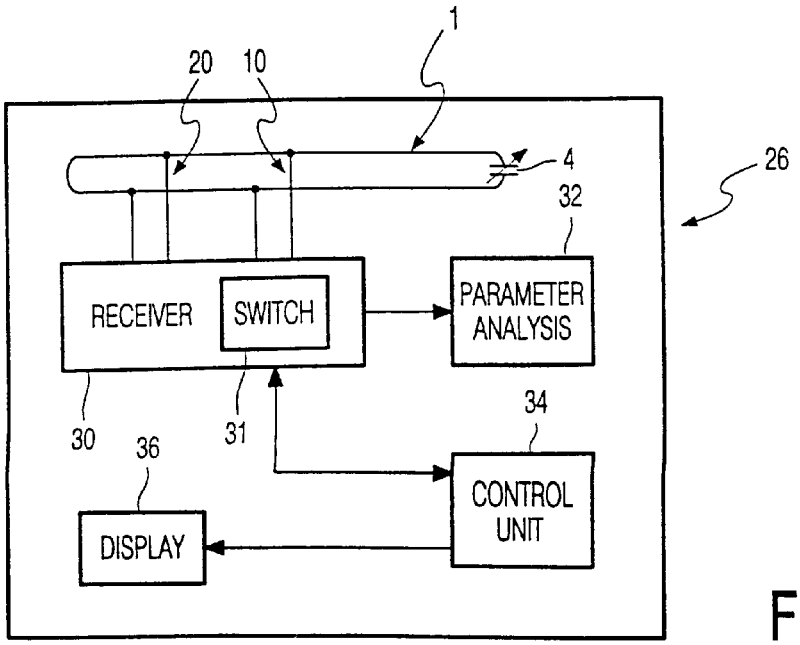
FIG. 2 shows a pager incorporating the antenna of FIG. 1.

By way of example, FIG. 2 shows a pager 26 incorporating a loop antenna 1 as previously described. The multiple feeds 10, 20 from the antenna 1 are provided to a receiver 30 which includes switching circuitry 31 for switching between feed terminals. The pager includes a parameter analysis circuit 32 for measuring the parameter chosen as the control for terminal switching. This parameter analysis circuitry 32 therefore includes elements for performing the analysis described above. Thus, the circuit may include level detection circuits for monitoring the signal amplitude of an incoming signal, and/or error analysis algorithm circuitry and/or a local oscillator to enable impedance measurement. The signals from the parameter analysis circuit 32 are fed to an overall control unit 34 which controls the operation of the switching circuitry 31 within the receiver 30. The control unit 34 may be considered to comprise all of the conventional circuitry required for a pager, which will not be described in this application. Finally, the pager shown in FIG. 2 is provided with a conventional display 36.

Although the loop antenna described has two pairs of feed terminals, it is possible to provide more feeds to the loop antenna, so that more accurate matching of the antenna impedance may be obtained for different operating conditions of the communications device employing the antenna. It is also possible to share one feed terminal between terminal pairs. In the simplest case, the loop may be provided with only three terminals to enable the invention to be implemented.

It will be appreciated that although the invention has been described specifically with reference to a pager (a receive only device), the invention is applicable to any reception or transmission device using a loop antenna, and which has different operating conditions some of which result in the proximity effects discussed above.

I claim:

1. A communications device comprising a loop antenna having a plurality of feed terminals defining at least two terminal pairs, control means for selecting one terminal pair to enable reception or transmission from the loop antenna using the selected terminal pair, wherein the selection of terminal pair is made by the control means based on the measurement of at least one parameter which is responsive to the proximity to the antenna of objects which absorb electromagnetic energy at or around the operating frequency of the antenna.

2. A device as claimed in claim 1, wherein the parameter comprises the bandwidth of the antenna.

3. A device as claimed in claim 1, wherein the parameter comprises the impedance of the loop measured at a terminal pair.

4. A device as claimed in claim 1, wherein the parameter comprises the reception quality of a known signal at the antenna.

5. A device as claimed in claim 1, wherein one terminal of each of the at least two terminal pairs is common to the pairs.

6. A pager comprising a communications device as claimed in claim 1.

7. A method of selecting one terminal pair in a communications device comprising a loop antenna having a plurality of feed terminals defining at least two terminal pairs, the method comprising measuring at least one parameter which is responsive to the proximity to the antenna of objects which absorb electromagnetic energy at or around the operating frequency of the antenna.

8. A method as claimed in claim 7, wherein the parameter comprises the bandwidth of the antenna.

9. A method as claimed in claim 7, wherein the parameter comprises the impedance of the loop measured at a terminal pair.

10. A method as claimed in claim 7, wherein the parameter comprises the reception quality of a known signal at the antenna.

* * * * *